United States Patent [19]

Choksi et al.

[11] 4,243,080

[45] Jan. 6, 1981

[54] METHOD OF MIXING PLURAL COMPONENTS

[75] Inventors: Pradip V. Choksi, Northridge; Kenneth R. Michael, Canoga Park; William H. Penny, Arcadia, all of Calif.

[73] Assignee: American Hospital Supply Corporation, Evanston, Ill.

[21] Appl. No.: 25,705

[22] Filed: Apr. 2, 1979

Related U.S. Application Data

[62] Division of Ser. No. 839,831, Oct. 6, 1977, Pat. No. 4,172,457.

[51] Int. Cl.[3] ..... B65B 3/04

[52] U.S. Cl. ..... 141/2; 128/272.1; 141/11; 366/150; 366/256

[58] Field of Search ..... 128/272.1, 218 M, 215, 128/216, 234; 141/1, 2, 18–29, 100, 258, 259, 260, 325–327, 329, 330, 112, 113, 311 R, 319–322, 9, 11; 206/219–221; 366/150, 256

[56] References Cited

U.S. PATENT DOCUMENTS

| | | | |
|---|---|---|---|
| 2,660,171 | 11/1953 | Dickinson et al. | 128/272 |
| 2,724,383 | 11/1955 | Lockhart | 128/215 |
| 2,726,656 | 12/1955 | Lockhart | 128/216 |
| 2,798,488 | 7/1957 | Hall | 128/272 |
| 3,163,163 | 12/1964 | Wilpurn | 128/272 |
| 3,376,999 | 4/1968 | Hart et al. | 128/218 M |
| 3,397,694 | 8/1968 | Ogle | 128/272 |
| 3,494,359 | 2/1970 | Zackheim | 128/218 M |
| 3,685,514 | 8/1972 | Cheney | 128/218 M |

*Primary Examiner*—Frederick R. Schmidt
*Attorney, Agent, or Firm*—Larry N. Barger

[57] ABSTRACT

A system for storing a dry powdered drug component and a liquid in separate containers and mixing them immediately prior to injection. The system has a hypodermic syringe with an axially slidable stopper, and the syringe is coupled to a rigid tubular housing with a low friction vacuum movable piston. Simple reciprocation of the syringe stopper with an attached plunger having a laterally extending thumb pad or other graspable slip resistant surface automatically reciprocates the housing's low friction piston and causes quick and complete turbulent mixing. There is no need to turn the device over and over in the operator's hands to alternately squeeze or push opposite ends of the device.

6 Claims, 5 Drawing Figures

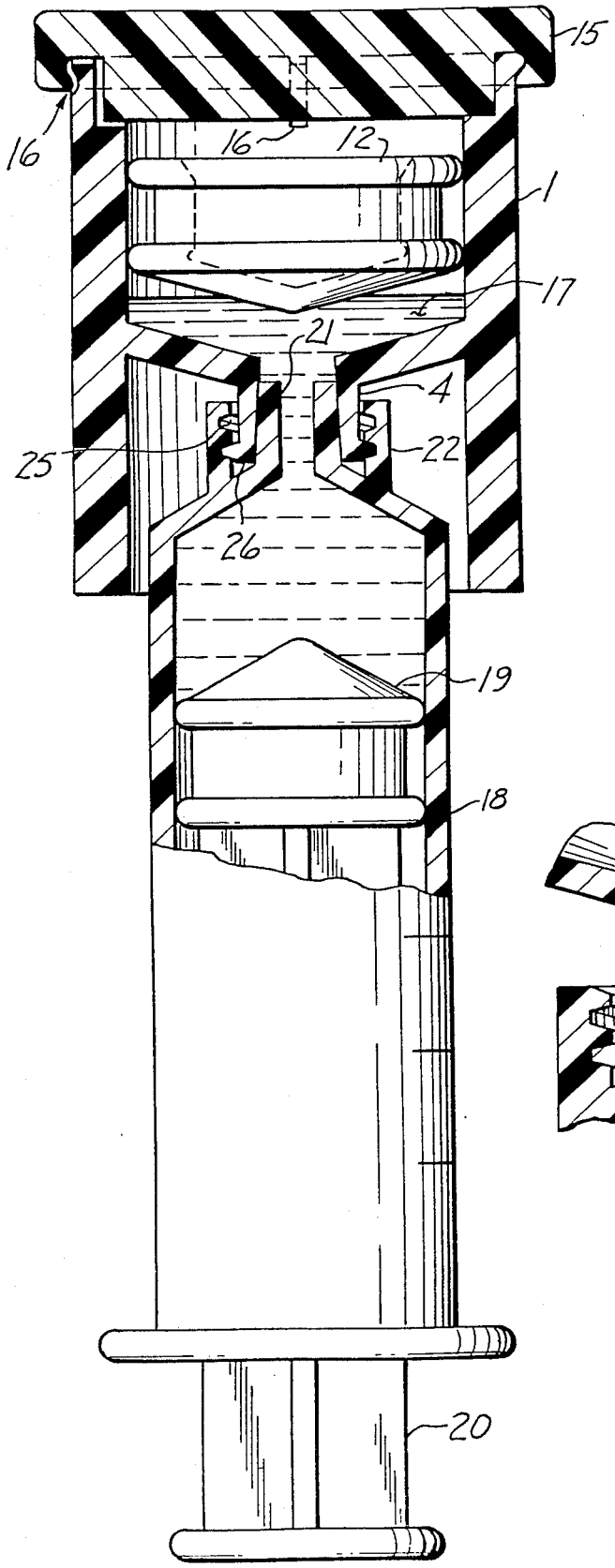
FIG. 4
FIG. 5
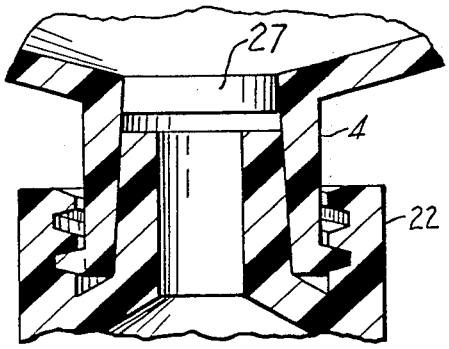

METHOD OF MIXING PLURAL COMPONENTS

This is a division, of application Ser. No. 839,831 filed Oct. 6, 1977, now U.S. Pat. No. 4,172,457.

BACKGROUND OF THE INVENTION

Many drugs, such as sodium thiopental, marketed under the trademark Sodium Pentothal, are stored in powdered lyophilized form and mixed with a liquid, such, as sterile water or normal saline immediately prior to use. This is necessary to maintain the stability and potency of such drugs.

The concept of mixing wet and dry components within the barrel of a syringe or vial has been known in the past. Much of the mixing has been done within glass vials, some of which have had dislodgable central barriers, such as U.S. Pat. No. 2,660,171. Mixing within the vial was a tedious process involving swishing and swirling and took considerable time.

Another type mixing syringe that had this same problem of slowly dissolving both components in a single compartment after the components were combined is described in the Ogle U.S. Pat. No. 3,397,694. In this patent, a liquid-containing vial has a piston for pressure injection of a liquid into the syringe barrel containing the dry powder. The powder can then slowly dissolved in the liquid entirely within the syringe barrel. The vial piston is shown as a very thick solid mass of rubber material, and would have a high frictional drag on the vial wall to seal it against the high pressures exerted on the stopper to puncture out the barrier system, as described in this patent. Because of such high frictional drag between the piston and vial, the piston is moved through only a one-time injection stroke, such as by thumb pressure (FIG. 5). Such thumb pressure would be unnecessary if the vial stopper were of low friction and trackable with retraction of the syringe plunger and stopper. As described, the device of this patent requires a manipulation first at the vial end, i.e. twisting or pushing, and then manipulation at the opposite end for pushing the syringe plunger for injection.

A similar wet-dry mixing syringe that included the problem mentioned above, i.e. tedious manipulation of opposite ends of the device, and shaking the combined components until the powder dissolved, was recently marketed by Abbott Laboratories under the name of "PENTOTHAL Ready-to-Mix Syringe." An undated instruction for its use is submitted with this application as background illustrating the problems mentioned in the Ogle Pat. No. 3,397,694. Since it is not known whether this Abbott syringe has been publicly available or on sale for more than a year, it is not submitted as prior art to applicants' invention, but only as a procedural illustration of the use of such devices of the type described in Ogle's U.S. Pat. No. 3,397,694.

While the above wet-dry mixing devices have accomplished the dissolving step in a single compartment, there has been a proposal to speed up such dissolving by a structure that couples two flexible containers similar in construction to toothpaste tubes together as shown in the Lockhart U.S. Pat. No. 2,724,383. As shown in FIGS. 8–10, the operator squeezes first one collapsible tube and then the other in a milking action to promote mixing. This is a tedious process because it requires substantial manual dexterity and sequential squeezing of alternate tubes in rapid succession.

SUMMARY OF THE INVENTION

The present invention relates to a system for mixing wet and dry drug components that is very simple to operate and requires no swirling or swishing for mixing. It also does not require a complicated manual procedure on different compartments of the system.

The invention includes a conventional hypodermic syringe with a rigid barrel containing a first component, and having an axially slidable stopper connected to a plunger extending from the barrel. Coupled to this syringe is a rigid tubular housing containing a second component and having a low friction vacuum movable piston in the housing. The housing's piston is vacuum trackable with the syringe stopper without being physically connected to such stopper. A simple manual reciprocation of the syringe plunger (such as the action of a bicycle tire pump) causes a like reciprocation of the housing piston creating a very turbulent mixing action as the components squirt back and forth between the syringe and housing through a small passage connecting them. The syringe has a convenient laterally extending thumb pad or other easily graspable surface on a plunger that will not slip out of an operator's hand during the retraction step. A quick 5–10 reciprocating strokes of the syringe plunger provides thorough mixing without the necessary swirling and swishing and waiting for the powder to dissolve.

The housing also has a special vent structure and supporting structure for use during filling and lyophilizing one component (dry powder) in the housing. Also, in one embodiment the housing and syringe are preconnected to share a common openable barrier separating the two components. In another embodiment, the housing and syringe are separate with individual closures that are removable immediately prior to mixing.

THE DRAWINGS

FIG. 4 is a sectional view of the coupled housing and syringe of FIGS. 1 and 2; and FIG. 5 is an enlarged sectional view of an alternate embodiment of the connecting structure between the housing and syringe which includes a removable barrier.

DETAILED DESCRIPTION

Figure 1:
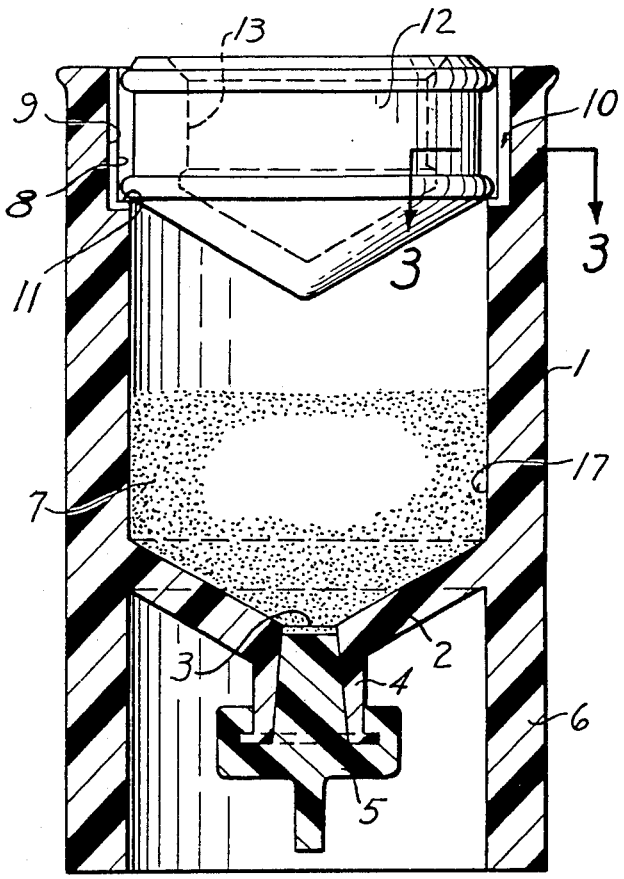
FIG. 1 is a sectional view of the housing with low friction stopper showing a venting structure for use during lyophilization.

FIG. 1 shows a rigid tubular housing with a cylindrical wall 1 joined to a transverse wall 2 that includes an outlet opening 3. Surrounding dispensing outlet 3 is a sleeve 4 with an internally tapered passage that is closed by a removable closure 5. Closure 5 can be snapped or screwed onto the flange of adapter 4 or held by a wedge fit in its tapered bore. Cylindrical wall 1 extends beyond closure 5 to provide a supporting collar structure 6 for supporting the housing upright on a table or the like during a filling and lyophilizing procedure. Thus, the dry powder 7, which can be sodium thiopental, is maintained in the housing without spilling.

An upper end of the tubular wall 1 has an offset portion 8 in which a series of vent grooves, such as 9 and 10, are formed. Supported on a ledge 11 of offset portion 8 is a low friction resilient piston 12 which can be of a rubber material. Piston 12 can have a hollow interior portion 13 to aid in its lateral resilience and low friction sealing. When the piston 12 is in the position shown in FIG. 1, the vent grooves, such as 9 and 10, are open. Although the vent grooves have been shown as being in the offset portion 8 of tubular wall 1, the vents could be grooves in stopper 12. A rib structure of other venting structure could be used in place of the grooves shown in FIG. 1.

After the housing has been filled with a drug component 7 and the piston 12 positioned in offset 8 as shown in FIG. 1, the unit of FIG. 1 is subjected to a lyophilizing procedure. The purpose of vent grooves 9 and 10 is to permit the evacuation of the chamber in the housing containing drug component 7.

After lyophilization, the piston 12 is moved downwardly in tubular wall 1 to form a sliding nonvented sealed relationship with tubular wall 1. This position is shown in FIG. 4, where a snap cap 15 or other closure is connected to an upper end of tubular wall 1. It is important to note that there is still a vent system between cap 15 and tubular wall 1 as shown, for example, at location 16. In FIG. 4 only the portion of the housing above piston 12 is vented, but a chamber 17 below piston 12 is not vented to the atmosphere. Conversely, in the FIG. 1 position of stopper 12 chamber 17 is vented to the atmosphere. The length and diameter of the housing 1 can be varied to accomodate the necessary volume. To illustrate this, a housing 1 is shown longer in FIG. 1 than in FIG. 4.

Although lyophilization after filling has been described, it may be desirable to have the powder bulk lyophilized and use a sterile powder filling technique.

Figure 2:
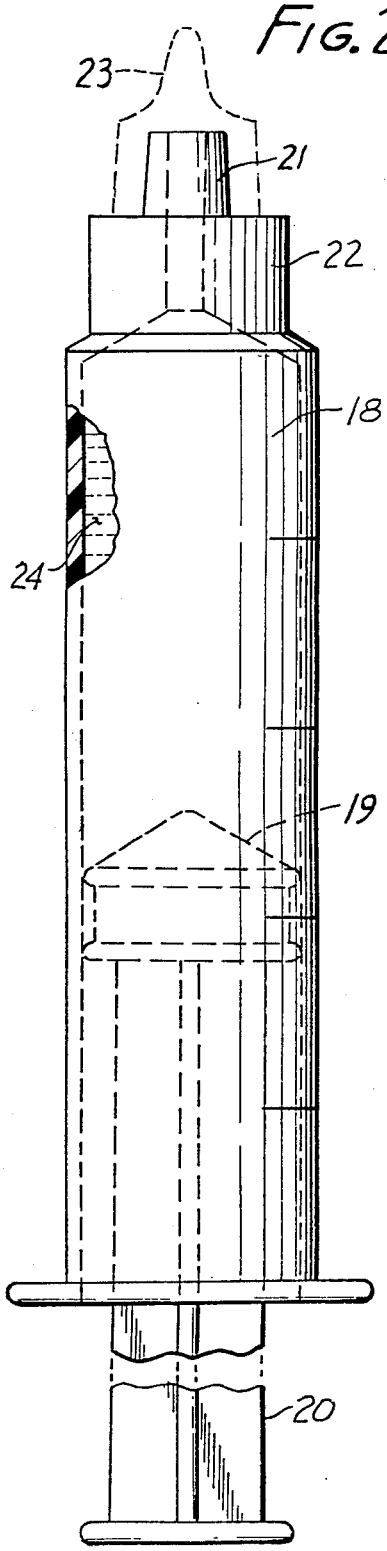
FIG. 2 is a side elevational view of a syringe for coupling with the housing.
Figure 3:
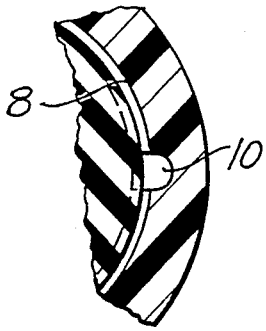
FIG. 3 is a sectional view taken along line 3—3 of FIG. 1.

FIG. 2 shows a conventional hypodermic syringe 18 with an axially slidable stopper 19 connected to a plunger 20. A forward end of the syringe has a tubular externally tapered adapter 21 that is surrounded by a spaced collar 22 that has internal threads on such collar. Preferably, adapter 21 extends beyond collar 22 for easy alignment with sleeve 4 of the housing. Prior to connecting the syringe and housing, a closure 23 seals off an outlet in adapter 21. Any number of different types of closures could be used as long as they provide an adequate seal. The syringe of FIG. 2 contains a liquid 24, such as sterile water or normal saline or dextrose, for use in dissolving the dry powder 7 of the housing.

After the closures 5 and 23 have been removed from the respective housing and syringe, the housing and syringe are coupled, as shown in FIG. 4, with internal threads 25 on collar 22 of the syringe lockingly engaging at least one laterally protruding ear 26 on sleeve 4 of the housing. This structure firmly locks the adapter 21 of the syringe to the sleeve 4 of the housing in a fluid-tight-fit.

Once coupled as shown in FIG. 4, the syringe plunger 20 is pushed upwardly to inject the liquid from the syringe into the housing. As this is done, piston 12 moves upwardly with air above piston 12 venting to the atmosphere through a vent, such as at 16. Cap 15 acts as a stop for the piston 12 and prevents it from reentering the open vent position shown in FIG. 1. Therefore, there is no atmospheric vent to the chamber 17 once the housing and syringe have been coupled as shown in FIG. 4.

Because of the very low frictional drag between piston 12 and tubular wall 1, piston 12 is movable downwardly in FIG. 4 by a retraction of plunger 20. It is noted that pistons and stoppers and injecting devices are usually moved under pressure because much higher forces can be generated by a pressure than can be generated by a vacuum. This is why barrier diaphragms are dislodged or impaled on a puncturing cannula with a pressure stroke rather than a vacuum stroke. Even under the theoretical ideal condition of a "perfect vacuum," only one atmosphere of pressure differential is created. A pressure stroke can generate pressures much higher than one atmosphere.

Since the piston 12 in FIG. 4 is vacuum movable by retraction of stopper 19, it is also pressure movable by a forward upper stroke of the stopper 19. Thus, piston 12 tracks or follows the general movement of piston 19. Thus, by repeated reciprocal action of stopper 19, the mixed liquid and dry components are squirted back and forth through the small passage in adapter 21. This causes very turbulent mixing action that speeds the dissolving of the dry powder in the liquid. The physical motion used by the health care personnel is simple. The barrel of the syringe is grasped in one hand and plunger 20 moved vigorously back and forth in a motion similar to that of a bicycle tire pump. The housing mounted on the syringe need not be manipulated during this turbulent mixing action. Once the dissolving step is complete, plunger 20 is retracted to draw the contents of the housing into the syringe, and the syringe disconnected. Next a hypodermic needle is attached to the syringe and the appropriate injection made.

In FIGS. 1–4 the housing and syringe are separate units that are individually capped prior to connection. If desired, the housing and syringe can be preconnected as shown in the fragmentary sectional view in FIG. 5. Caps 5 and 23 can be replaced with a common dislodgable barrier 27. This barrier 27 could be located in either the housing unit or the syringe unit.

The above plural component mixing system is very economical. The syringe can be a conventional disposable plastic syringe, while the housing can be of glass or an inexpensive molded thermoplastic construction. It has been found that a piston 12 of a rubber material with a hollow interior used to snap on syringe plunger works well as the low friction piston. This piston design could be modified to include different wiper ring configurations or have different dimensions, so long as the static friction between the piston 12 and tubular wall 1 were less than the force that could be generated by a vacuum within the connected syringe barrel.

Although the example has been given of mixing a liquid with a dry powder, the system can also be used to mix two liquids. Also, if desired, a liquid diluent could be placed in the housing and a dry powder in the syringe. The housing structure has been shown which is very suitable for filling with a dry powder from the stopper end, however, the powder could be inserted from the coupling end, if desired.

In the foregoing specification, specific embodiments have been used to describe the invention. It is understood that those skilled in the art can make certain modifications to these embodiments without departing from the spirit and scope of the invention.

We claim:

1. A method of charging a rigid tubular housing having an axially slidable piston with a dry component for subsequently mixing with a second component comprising the steps of:

(a) placing a component in a tubular housing having a sealed outlet and a separate inlet having a vent;

(b) placing a piston in a first position on the housing to provide a venting structure to the component within the housing;

(c) lyophilizing the contents of the housing;

(d) moving the piston into the housing into a second position in which the piston is in a slidable sealing relationship with a nonvented portion of the housing; and (e) securing stop means to the housing to prevent return of the piston to the vented area of the housing.

2. A method of charging a rigid tubular housing having an axially slidable piston with a dry component for subsequently mixing with a second component comprising the steps of:

(a) placing a sterile component in a sterile tubular housing having a sealed outlet and an inlet;

(b) placing an axially slidable piston in the tubular housing to seal off the inlet; and (c) closing said housing inlet with a rear stop means while maintaining a vent passage to the atmosphere rearwardly of the piston, which stop is sufficiently secured to the housing to prevent dislodgment during rearward movement of the piston within the housing.

3. A method of mixing two components of a drug or the like in a system that has an openable barrier between interiors of a rigid tubular housing with a vaccum movable piston, and a hypodermic syringe with an axially slidable stopper, which housing contains a first component and the syringe contains a second component, said method including the steps of:

(a) opening said barrier between the syringe and housing;

(b) pumping the first component from the syringe into the housing for mixing with the second component within the housing, and forming a fluid coupling between the piston and stopper;

(c) reciprocating the syringe stopper in a manner that causes the piston to similarly reciprocate within the housing without a structural connection between the stopper and piston to thorougly mix the two components;

(d) retracting the stopper within the syringe barrel to extract at least an injectable portion of the mixed components from the housing into the syringe; and (e) disconnecting the housing from the syringe enabling the dispensing of the mixed components from the syringe.

4. A method as set forth in claim 3, wherein the method includes a further step of connecting a hypodermic needle to the syringe after disconnection of the housing from the syringe.

5. A method of mixing two components of a drug or the like in a system that has a rigid tubular housing with a vacuum movable piston containing a first component and having a sealed outlet, and a hypodermic syringe with an axially slidable stopper containing a second component and having a sealed outlet, said method including the steps of:

(a) opening the outlets of the housing and syringe;

(b) coupling the outlets of the housing and syringe in flow communication;

(c) pumping the second component from the syringe into the housing for mixing with the second component within the housing, and forming a fluid coupling between the piston and stopper;

(d) reciprocating the syringe stopper in a manner that causes the piston to similarly reciprocate within the housing without a structural connection between the stopper and piston to thoroughly mix the two components;

(e) retracting the stopper within the syringe barrel to extract at least an injectable portion of the mixed components from the housing into the syringe; and (f) disconnecting the housing from the syringe enabling the dispensing of the mixed components from the syringe.

6. A method as set forth in claim 5, wherein the method includes a further step of connecting a hypodermic needle to the syringe after disconnection of the housing from the syringe.

* * * * *